US009595770B2

(12) United States Patent
Nagasaki et al.

(10) Patent No.: US 9,595,770 B2
(45) Date of Patent: Mar. 14, 2017

(54) TERMINAL FITTING

(71) Applicant: Sumitomo Wiring Systems, Ltd., Yokkaichi, Mie (JP)

(72) Inventors: Takashi Nagasaki, Mie (JP); Shohei Mitsui, Mie (JP)

(73) Assignee: SUMITOMO WIRING SYSTEMS, LTD., Yokkaichi-mie (JP)

( * ) Notice: Subject to any disclaimer, the term of this patent is extended or adjusted under 35 U.S.C. 154(b) by 0 days.

(21) Appl. No.: 15/031,757

(22) PCT Filed: Nov. 6, 2014

(86) PCT No.: PCT/JP2014/079412

§ 371 (c)(1),
(2) Date: Apr. 25, 2016

(87) PCT Pub. No.: WO2015/072385

PCT Pub. Date: May 21, 2015

(65) Prior Publication Data

US 2016/0268701 A1 Sep. 15, 2016

(30) Foreign Application Priority Data

Nov. 13, 2013 (JP) ..... 2013-234850

(51) Int. Cl.
*H01R 4/18* (2006.01)
*H01R 13/11* (2006.01)
(Continued)

(52) U.S. Cl.
CPC ..... *H01R 4/185* (2013.01); *H01R 4/58* (2013.01); *H01R 13/113* (2013.01); *H01R 13/5208* (2013.01); *H01R 4/188* (2013.01)

(58) Field of Classification Search
CPC ..... H01R 4/185; H01R 4/58; H01R 13/113
(Continued)

(56) References Cited

U.S. PATENT DOCUMENTS 5,791,945 A 8/1998 Myer et al.
6,341,984 B1 * 1/2002 Murakami ..... H01R 13/5208 439/587

(Continued)

FOREIGN PATENT DOCUMENTS

JP 4-10973 1/1992
JP 7-45322 2/1995

(Continued)

OTHER PUBLICATIONS

International Search Report.

*Primary Examiner* — Edwin A. Leon
(74) *Attorney, Agent, or Firm* — Gerald E. Hespos; Michael J. Porco; Matthew T. Hespos

(57) ABSTRACT

A terminal fitting (20) includes a rectangular tubular main body (30) with a bottom wall (30A), side walls (30B, 30C) extending from opposite sides of the bottom wall (30A) and a ceiling wall (30D, 30E) facing the bottom wall (30A). A main spring (31) is in the main body (30) and resiliently contacts a mating terminal. An auxiliary spring (35) is cantilevered from the bottom wall (30A) and into the main body (30) for contacting the main spring (31) from a side opposite the mating terminal. Protection walls (36) are formed on ends of the side walls (30B, 30C) on the side of the bottom wall (30A) for laterally covering the auxiliary spring (35). Chamfered portions (37) are formed on surfaces of the protection walls (36) for contacting an inner wall (52) of a hole (51) of a collective rubber plug (50).

5 Claims, 10 Drawing Sheets

(51) Int. Cl.
*H01R 13/52* (2006.01)
*H01R 4/58* (2006.01)

(58) Field of Classification Search
USPC ..... 439/842–843, 852, 862, 889, 884, 587, 439/589, 595, 752
See application file for complete search history.

(56) References Cited

U.S. PATENT DOCUMENTS

| | | | | |
|---|---|---|---|---|
| 7,156,704 | B2 | 1/2007 | Shimizu | |
| 7,553,186 | B2 * | 6/2009 | Morikawa | H01R 13/5208 439/587 |
| 7,641,502 | B2 * | 1/2010 | Itou | H01R 13/4364 439/383 |
| 2011/0028036 | A1 | 2/2011 | Sakamaki et al. | |

FOREIGN PATENT DOCUMENTS

| | | |
|---|---|---|
| JP | 7-35316 | 8/1995 |
| JP | 11-505360 | 5/1999 |
| JP | 2004-14505 | 1/2004 |
| JP | 2004-362832 | 12/2004 |
| JP | 4385923 | 10/2009 |
| WO | 2009128378 | 10/2009 |

* cited by examiner

TERMINAL FITTING

BACKGROUND

1. Field of the Invention

The present invention relates to a terminal fitting to be inserted into a hole of a rubber plug.

2. Description of the Related Art

Japanese Patent No. 4385923 discloses a terminal fitting that is to be inserted into a hole of a rubber plug. This terminal fitting includes a rectangular tube portion into which a mating terminal is to be inserted, a main spring piece configured to resiliently come into contact with the mating terminal is provided in this rectangular tube portion, and an auxiliary spring piece is provided below this main spring piece. A stopper piece is formed to laterally protrude on a tip part of the auxiliary spring piece, and receiving portions are formed on opposite side walls of the rectangular tube portion. The receiving portions receive the stopper piece when an external matter collides with the auxiliary spring piece for preventing excessive deflection of the auxiliary spring piece.

Excessive deflection of the auxiliary spring piece caused by external matter is prevented in the above terminal fitting, but the auxiliary spring piece is exposed to the outside of the rectangular tube portion. Thus, when the terminal fitting is inserted into a hole of a rubber plug, a reaction force from an inner wall of the hole of the rubber plug may directly act on the auxiliary spring piece to cause deformation or the like.

The present invention was completed based on the above situation and aims to prevent an external force from directly acting on an auxiliary spring piece.

SUMMARY

The present invention is directed to a terminal fitting to be inserted into a hole of a rubber plug. The terminal fitting includes a main body portion in the form of a rectangular tube. A main spring piece is provided in the main body portion and is configured to resiliently come into contact with a mating terminal. An auxiliary spring piece is provided in the main body portion and is capable of contacting the main spring piece from a side opposite to the mating terminal. The main body portion includes a bottom wall, a pair of side walls extending from opposite side edges of the bottom wall while facing each other and a ceiling wall arranged to face the bottom wall. The auxiliary spring piece extends in a cantilever manner from the bottom wall. Protection walls are formed on end parts of the side walls on the side of the bottom wall for laterally covering the auxiliary spring piece. Chamfered portions are formed on surfaces of the protection walls and are capable of contacting an inner wall of the hole of the rubber plug.

According to this configuration, the inner wall of the hole directly acts on the protection walls and does not act on the auxiliary spring piece when the terminal fitting is inserted into the hole of the rubber plug. Thus, the auxiliary spring piece is not deformed. Further, the protection walls are formed with the chamfered portions so that the rubber plug is not damaged by the protection walls even if the inner wall of the hole directly acts on the protection walls.

The chamfered portion may include a first tapered surface formed by striking a corner part of a tip part of the protection wall. According to this configuration, the damage of the rubber plug can be prevented by the first tapered surfaces.

The chamfered portion may include a second tapered surface formed continuously with the first tapered surface by bending a base end part of the protection wall. According to this configuration, the damage of the rubber plug can be prevented also by the second tapered surfaces in addition to by the first tapered surfaces. Further, the rounded protection walls are formed easily by the first and second tapered surfaces and the damage of the rubber plug is prevented more easily.

Slits may be formed from the tip part to the base end part of the protection wall both before and after the protection wall. According to this configuration, since the protection wall is arranged between a pair of front and rear slits, the bending of the protection wall is facilitated. Specifically, even a small-size terminal having a narrow bending region can be bent effortlessly and excess thickness and the like associated with bending can be suppressed.

The main spring piece may include a turned portion extending forward from a front edge of the bottom wall along a substantially arcuate path. A tongue piece may extend backward from an extending end of the turned portion and may have a contact portion to be held in contact with the mating terminal. Covering walls may be formed on end parts of front end sides of the side walls on the side of the bottom wall for laterally covering the turned portion. The covering walls may be shaped to be aligned with the protection walls in a front-back direction. According to this configuration, the inner wall of the hole directly acts on the covering walls and does not act on the main spring piece when the terminal fitting is inserted into the hole of the rubber plug. Thus, the main spring piece is not deformed. Further, since the covering walls and the protection walls can be formed simultaneously, it is not necessary to add a step of forming the covering walls.

According to the present invention, it is possible to prevent an external force from directly acting on an auxiliary spring piece.

DETAILED DESCRIPTION

Figure 1:
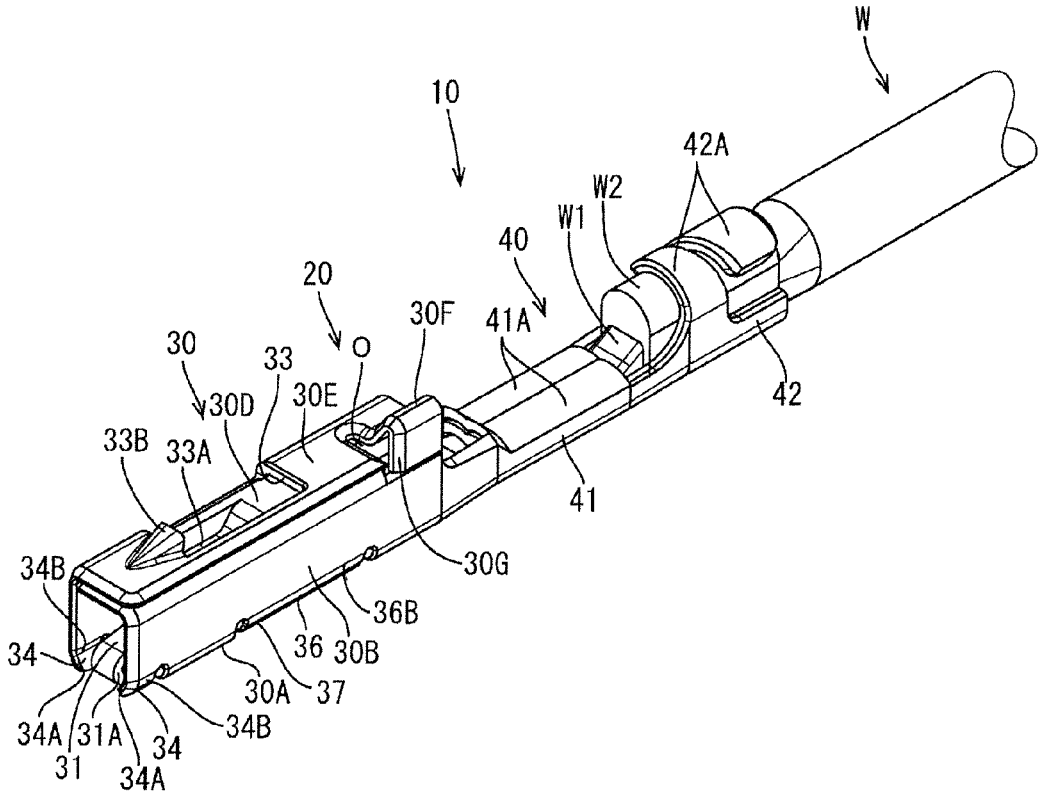
FIG. 1 is a perspective view showing a wire with terminal fitting of an embodiment.
Figure 2:
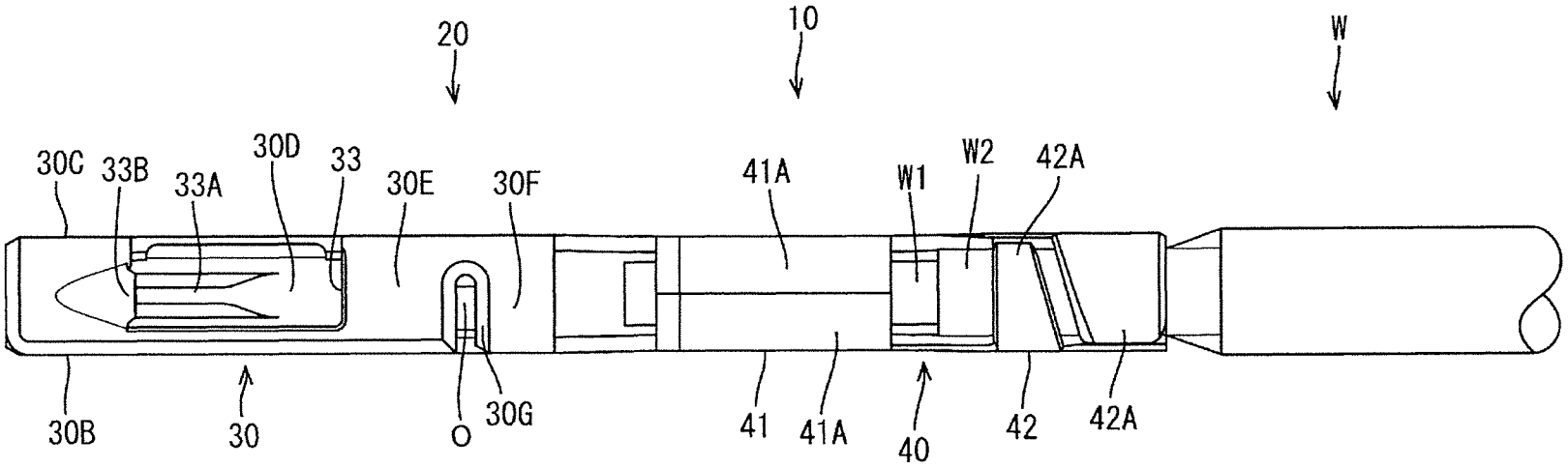
FIG. 2 is a plan view of the wire with terminal fitting.
Figure 3:
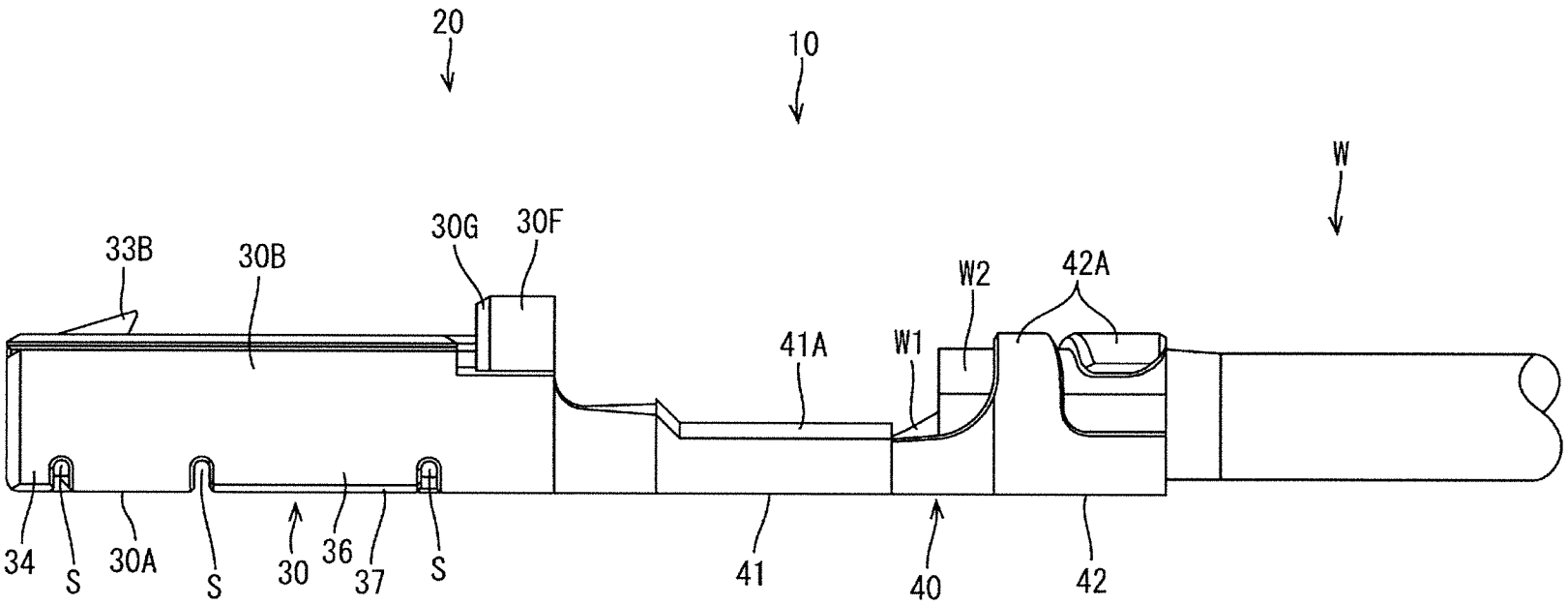
FIG. 3 is a side view of the wire with terminal fitting.
Figure 4:
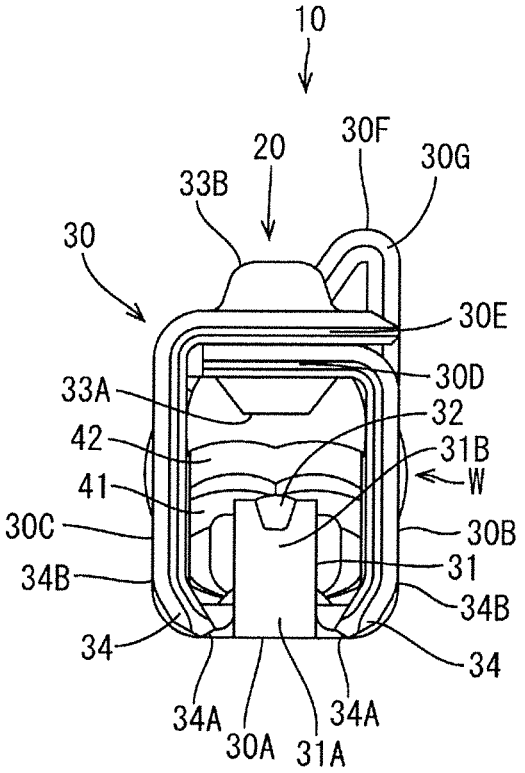
FIG. 4 is a front view of the wire with terminal fitting.

An embodiment of the present invention is described with reference to FIGS. 1 to 10. A wire with terminal fitting 10 in this embodiment includes a wire W and a terminal fitting 20 connected to an end of this wire W, as shown in FIG. 1. The wire W is composed of a core W1 formed by bundling a plurality of metal strands and an insulation coating W2 covering this core W1. The terminal fitting 20 includes a main body 30 having a rectangular tube shape that extends in a front-back direction and a barrel portion 40 arranged behind this main body 30.

The barrel portion 40 includes a wire barrel 41 to be crimped to the core W1 and an insulation barrel 42 to be crimped to the insulation coating W2. The wire barrel 41 includes a pair of wire barrel pieces 41A and these wire barrel pieces 41A are crimped so that tip parts thereof bite into the core W1. On the other hand, the insulation barrel 42 includes a pair of insulation barrel pieces 42A and these insulation barrel pieces 42A are so crimped as to wrap around the insulation coating W2 from opposite sides.

The main body 30 includes a bottom wall 30A, a pair of side walls extending from opposite side edges of this bottom wall 30A while facing each other, i.e. the side wall located on the left side (hereinafter, referred to as the "left wall") 30B and the side wall located on the right side (hereinafter, referred to as the "right wall") 30C when viewed from behind the main body portion 30. Further, the main body 30 further includes an inner ceiling wall 30D extending from an extending end of the left side wall 30B toward the right side wall 30C located on the right and an outer ceiling wall 30E extending from an extending end of the right side wall 30C toward the left side wall 30B along an outer surface of the inner ceiling wall 30D. The inner ceiling wall 30D is arranged to face the bottom wall 30A. Note that a stabilizer 30F for guiding a movement when the terminal fitting 20 is inserted into a cavity of a housing is formed on a rear end part of the upper surface of the main body 30.

Figure 5:
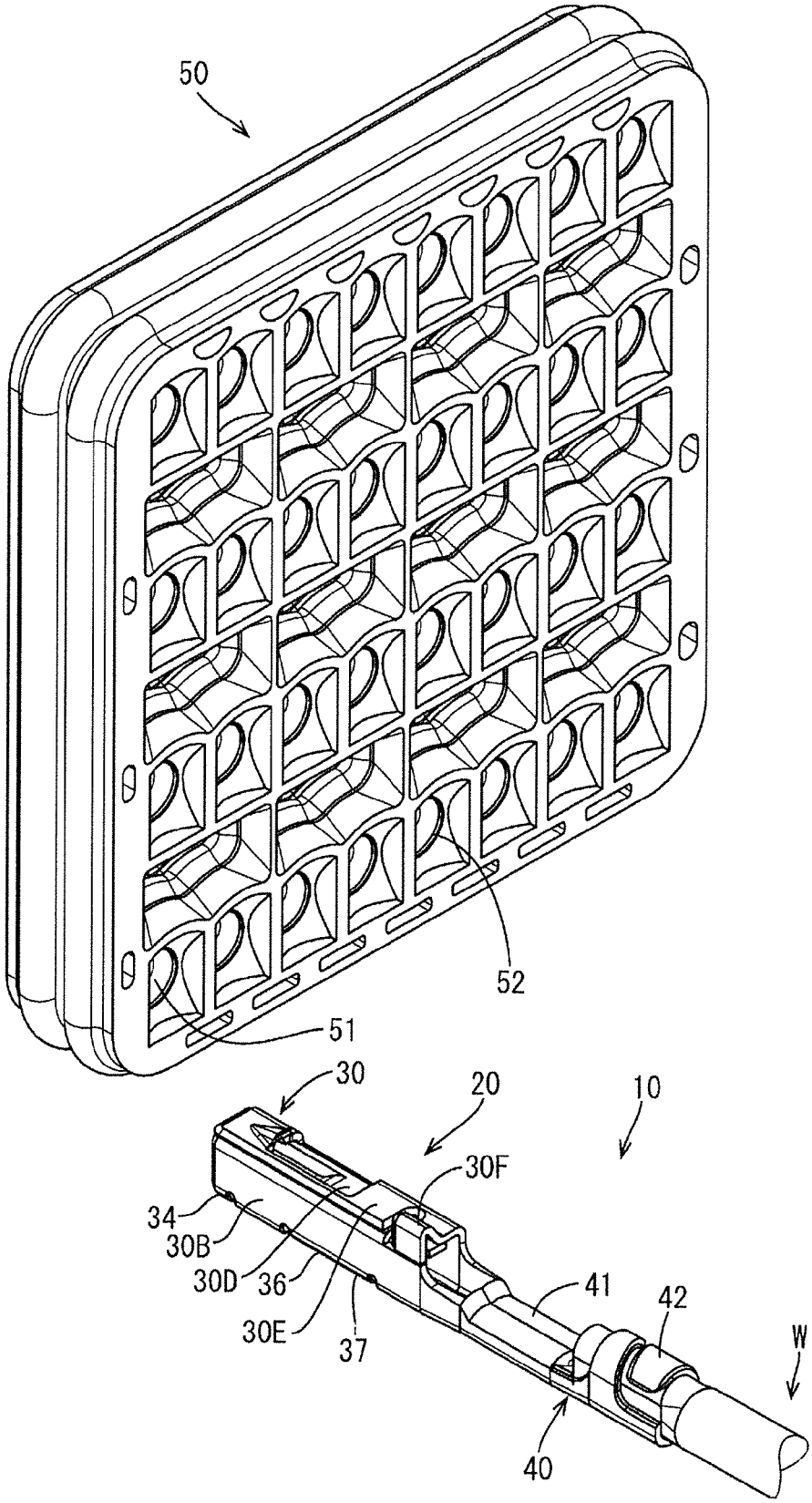
FIG. 5 is a perspective view showing a state where the wire with terminal fitting is inserted into a collective rubber plug.
Figure 6:
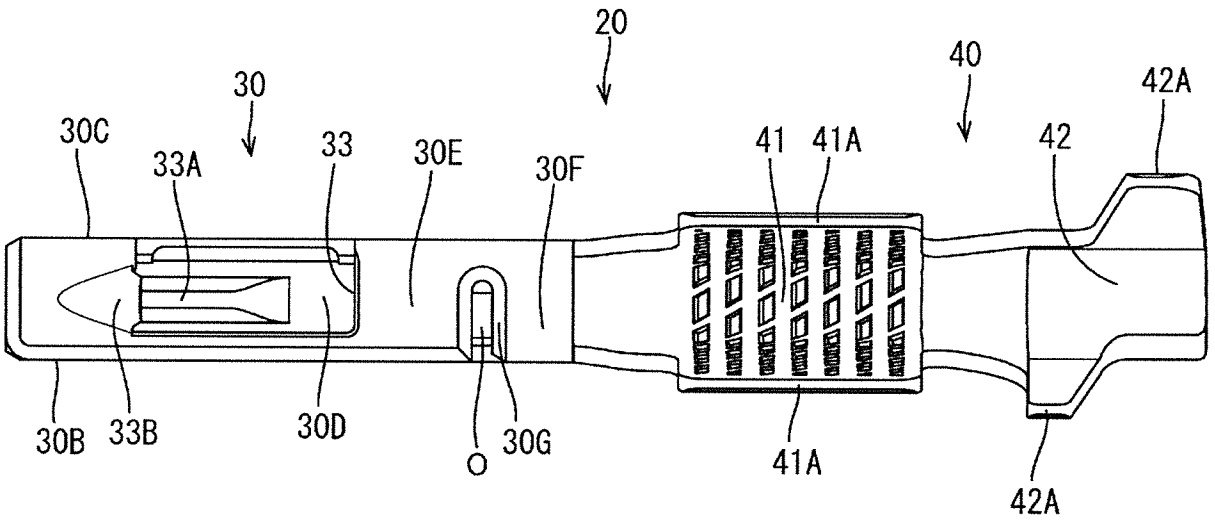
FIG. 6 is a plan view of a terminal fitting.
Figure 7:
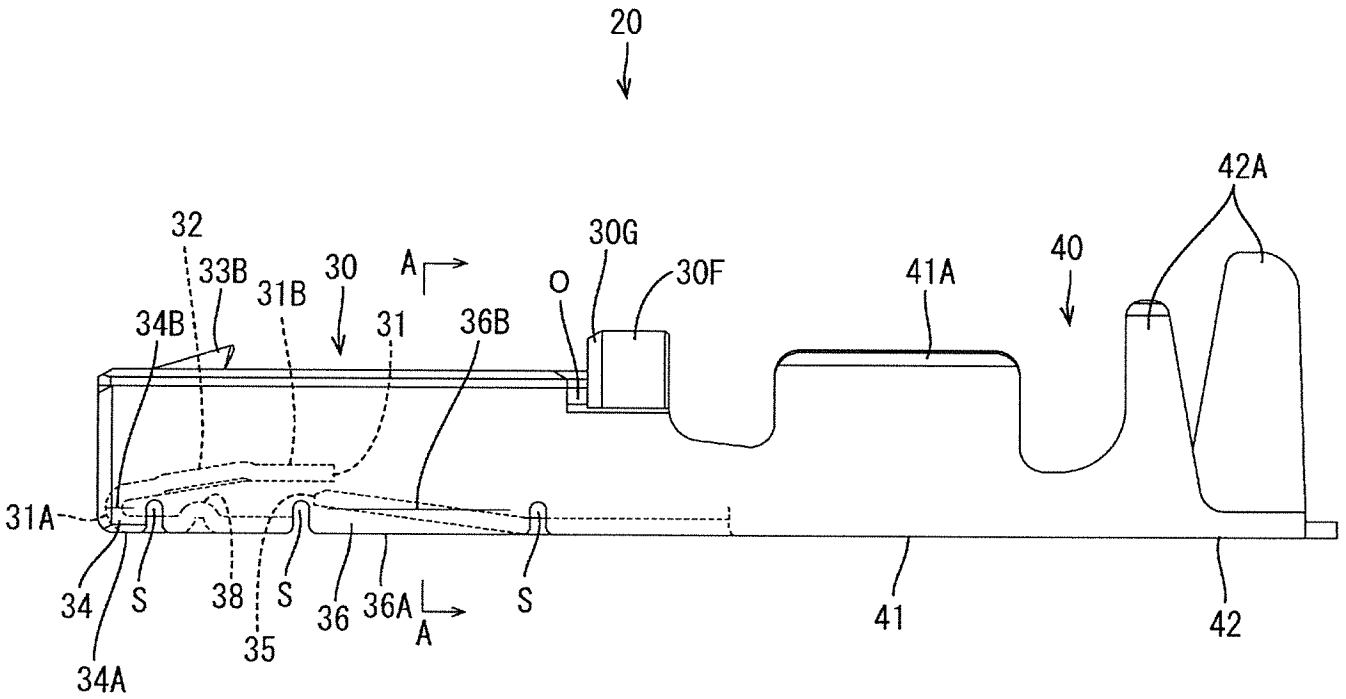
FIG. 7 is a side view of the terminal fitting.
Figure 8:
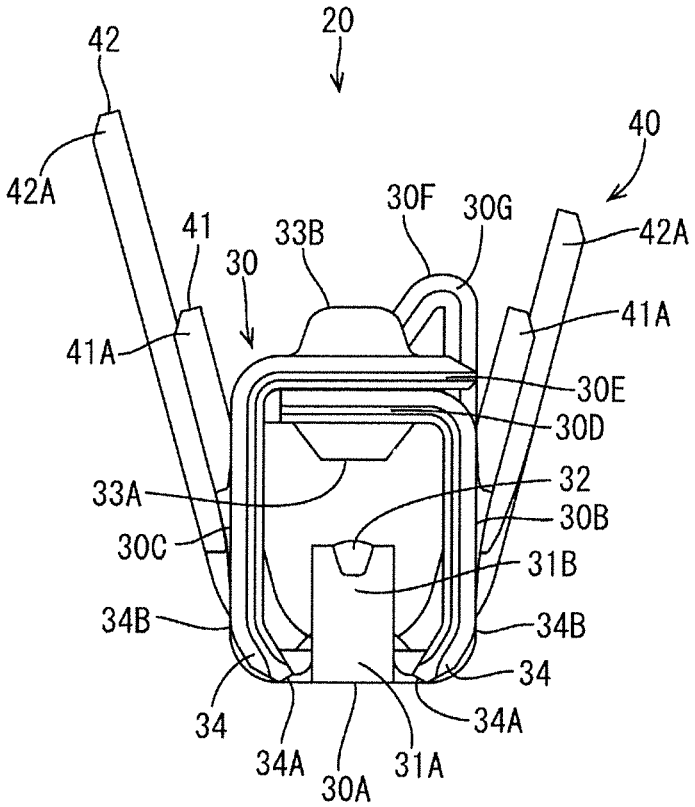
FIG. 8 is a front view of the terminal fitting.

Further, as shown in FIGS. 6 to 8, a tapered surface 30G is formed on the front edge of the stabilizer 30F. The front edge of the stabilizer 30F serves as a contact edge configured to come into contact with an inner wall 52 of a hole 51 of a collective rubber plug 50 shown in FIG. 5 when the main body 30 is inserted into the hole 51 from behind. Further, as shown in FIG. 6, the tapered surface 30G is formed continuously into a substantially U shape from the front edge of the stabilizer 30F to that of a clearance O. Thus, the tapered surface 30G is formed over an entire area in a part of the stabilizer 30F projecting up from the upper surface of the outer ceiling wall 30E.

As shown in FIG. 6, the main body 30 is formed with a cut 33 for exposing the outer surface of the inner ceiling wall 30D by cutting off a part of the outer ceiling wall 30E, and a part of a receiving portion 33A is exposed to outside in this cut 33. Further, a rearwardly open V-shaped locking portion 33B is formed on the front edge of the cut 33. As shown in FIG. 7, this locking portion 33B is formed to become higher toward the back, and the rear end opening edge thereof is undercut. An unillustrated locking lance is locked to the locking portion 33B from behind so that the terminal fitting 20 is held in the housing.

As shown in FIG. 7, a main spring piece 31 is formed in the main body 30 and extends back from the front edge of the bottom wall 30A. This main spring piece 31 includes a turned portion 31A turned while extending forward along a substantially arcuate path from the front edge of the bottom wall 30A and a tongue 31B extending back from an extending end of the turned portion 31A.

The tongue 31B of the main spring piece 31 is struck to form an upwardly projecting contact portion 32 to be held in contact with an unillustrated mating terminal. On the other hand, the inner ceiling wall 30D is struck to form the receiving portion 33A projecting down as shown in FIG. 8. When the mating terminal is fit into the main body 30 from the front, the main spring piece 31 is deflected and deformed down by being pressed by the mating terminal and the mating terminal is sandwiched between the contact portion 32 and the receiving portion 33A. Thus, the mating terminal and the terminal fitting 20 are connected electrically conductively. Note that covering walls 34 for laterally covering the turned portion 31A are formed on end parts of front end sides of the left and right side walls 30B, 30C on the side of the bottom wall 30A.

Further, as shown in FIG. 7, the bottom wall 30A is formed with an excessive deflection preventing portion 38 that is arranged below the contact portion 32. Furthermore, the excessive deflection preventing portion 38 is formed to project up by striking the bottom wall 30A. The main spring piece 31 that is about to be deflected excessively and deformed down contacts the excessive deflection preventing portion 38 from above, thereby preventing excessive deflection of the main spring piece 31.

Figure 9:
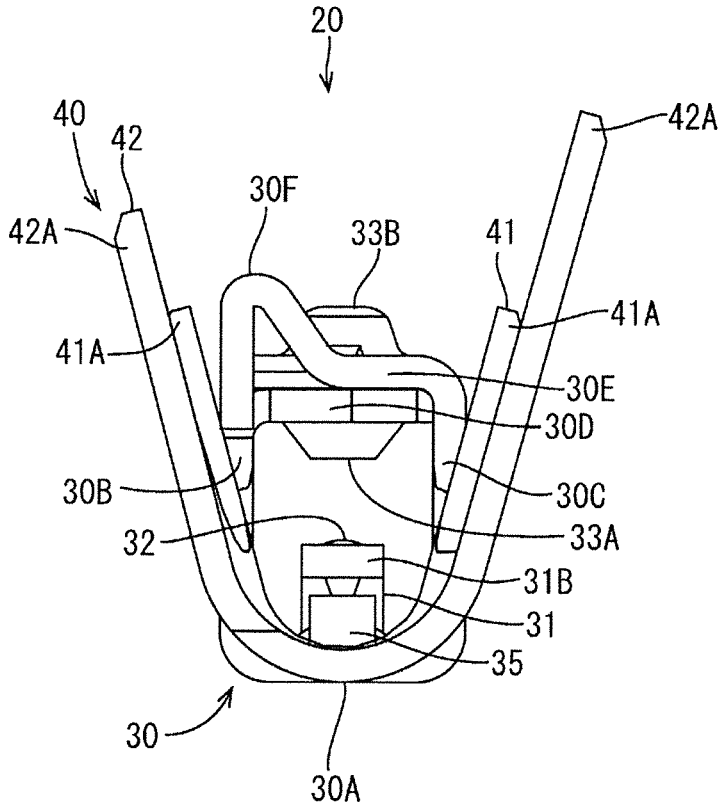
FIG. 9 is a rear view of the terminal fitting.

As shown in FIG. 9, an auxiliary spring piece 35 for reinforcing the spring elasticity of the main spring piece 31 is provided below the main spring piece 31. This auxiliary spring piece 35 is cut out from the bottom wall 30A and extends forward in a cantilever manner as shown in FIG. 7. A tip part of the auxiliary spring piece 35 is arranged below a tip part of the main spring piece 31. When the main spring piece 31 is deflected and deformed down, the tip part of the main spring piece 31 comes into contact with that of the auxiliary spring piece 35. Thus, both spring pieces 31, 35 are deflected and deformed simultaneously, and a contact pressure with the mating terminal is strengthened by a contact pressure by the auxiliary spring piece 35. Further, protection walls 36 are formed on end parts of the left and right side walls 30B, 30C on the side of the bottom wall 30A for laterally covering the auxiliary spring piece 35. The covering walls 34 are shaped to align with the protection walls 36 in a front-back direction. Therefore, the covering walls 34 and the protection walls 36 can be formed simultaneously.

Figure 10:
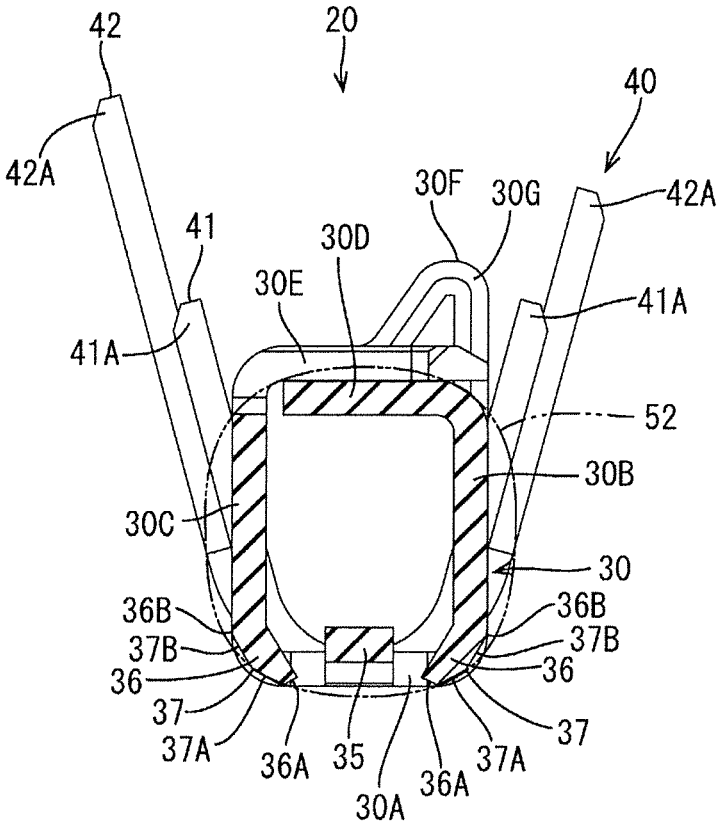
FIG. 10 is a section along A-A of FIG. 7.

As shown in FIG. 10, chamfered portions 37 are formed on outer surfaces of the protection walls 36 and are capable of contacting the inner wall 52 of the hole 51 of the collective rubber plug 50. This chamfered portion 37 includes a first tapered surface 37A formed by striking a corner part of a tip part 36A of the protection wall 36 and a second tapered surface 37B formed above and continuously with the first tapered surface 37A by bending a base end part 36B of the protection wall 36. As shown in FIG. 7, slits S are formed respectively from the tip part 36A to the base end part 36B of the protection wall 36 both before and after the protection wall 36. Further, a slit S is also formed from a tip part 34A to a base end part 34B of the covering wall 34 behind the covering wall 34. These three slits S all are shaped identically.

This embodiment is configured as described above. Next, functions thereof are described. When the terminal fitting 20 is inserted into the hole 51 of the collective rubber plug 50 from behind as shown in FIG. 5, the hole 51 is widened and deformed by the main body 30. At this time, the main body 30 receives a reaction force from the inner wall 52 of the deformed hole 51. First, the front end of the main body 30 receives the reaction force at an entrance part of the hole 51. At this time, the turned portion 31A of the main spring piece 31 is protected by the covering walls 34. Further, the outer surfaces of the covering walls 34 are chamfered surfaces so that the collective rubber plug 50 is not damaged.

When being further inserted, the main body 30 receives the reaction force from the inner wall 52 of the hole 51 at the position of the auxiliary spring piece 35. The auxiliary spring piece 35 similarly is protected by the protection walls 36. Thus, no external force directly acts on the auxiliary spring piece 35 and the deformation of the auxiliary spring piece 35 can be prevented. Further, since the outer surfaces of the protection walls 36 are formed as the chamfered portions 37 in the form of chamfered surfaces by the first tapered surfaces 37A and the second tapered surfaces 37B. Thus, the collective rubber plug 50 is not damaged.

The stabilizer 30F further widens and deforms the hole 51 when approaching a hole edge part of the hole 51. Thus, the stabilizer 30F receives a stronger reaction force from the inner wall 52 of the hole 51. However, the damage of the collective rubber plug 50 is prevented by the tapered surface 30G.

As described above, the inner wall 52 of the hole 51 directly acts on the protection walls 36 and does not act on the auxiliary spring piece 35 when the terminal fitting 20 is inserted into the hole 51 of the collective rubber plug 50. Thus, the auxiliary spring piece 35 is not deformed. Further, the protection walls 36 are formed with the chamfered portions 37. Thus, even if the inner wall 52 of the hole 51 directly acts on the protection walls 36, the collective rubber plug 50 is not damaged by the protection walls 36.

The chamfered portion 37 may include the first tapered surface 37A formed by striking the corner of the tip part 36A of the protection wall 36. According to this configuration, the first tapered surfaces 37A prevent damage of the collective rubber plug 50*e*.

The chamfered portion 37 may include the second tapered surface 37B formed continuously with the first tapered surface 37A by bending the base end part 36B of the protection wall 36. According to this configuration, the damage of the collective rubber plug 50 can be prevented by the second tapered surfaces 37B in addition to by the first tapered surfaces 37A. Further, the rounded protection wall 36 is formed easily by the first and second tapered surfaces 37A, 37B so that damage of the collective rubber plug 50 is prevented more easily.

The slits S may be formed from the tip part 36A to the base end part 36B of the protection wall 36 both before and after the protection wall 36. According to this configuration, the protection wall 36 is arranged between a pair of front and rear slits S. Thus, the bending of the protection wall 36 is facilitated. Specifically, even a small-size terminal can be bent effortlessly and excess thickness and the like associated with bending can be suppressed.

The main spring piece 31 may include the turned portion 31A turned while extending forward along a substantially arcuate path from the front edge of the bottom wall 30A. Additionally the tongue piece 31B extending back from the extending end of the turned portion 31A and having the contact portion 32 to be held in contact with the mating terminal. The covering walls 34 for laterally covering the turned portion 31A may be formed on the end parts of the front end sides of the side walls 30B, 30C on the side of the bottom wall 30A. The covering walls 34 may be shaped to be aligned with the protection walls 36 in the front-back direction. According to this configuration, the inner wall 52 of the hole 51 directly acts on the covering walls 34 and does not act on the main spring piece 31 when the terminal fitting 20 is inserted into the hole 51 of the collective rubber plug 50. Thus, the main spring piece 31 is not deformed. Further, since the covering walls 34 and the protection walls 36 can be formed simultaneously during the production of the terminal fitting 20, it is not necessary to add a step of forming the covering walls 34.

The invention is not limited to the above described and illustrated embodiment. For example, the following embodiments also are included in the scope of the invention.

The chamfered portion 37 including both the first and second tapered surfaces 37A, 37B is illustrated in the above embodiment. However, the chamfered portion may include only either one of the tapered surfaces according to the present invention. Further, the chamfered surface shape of the chamfered portion may be an arcuate shape.

The protection wall 36 is formed between the pair of front and rear slits in the above embodiment. However, the positions and the number of the slit(s) do not matter according to the present invention. Further, the slits need not necessarily be provided. In the case of a relatively large terminal fitting, the protection wall may be formed by striking.

The covering walls 34 and the protection walls 36 are shaped to be aligned in the front-back direction in the above embodiment. However, the covering walls may be bent more inwardly of the main body 30 than the protection walls 36 according to the present invention.

The ceiling wall having a double wall structure composed of the inner ceiling wall 30D and the outer ceiling wall 30E placed one over the other in the above embodiment. However, the ceiling wall may be composed of a single wall according to the present invention.

LIST OF REFERENCE SIGNS

10 . . . wire with terminal fitting
20 . . . terminal fitting
30 . . . main body
30A . . . bottom wall
30B . . . left side wall
30C . . . right side wall
30D . . . inner ceiling wall
30E . . . outer surface
31 . . . main spring piece
31A . . . turned portion
34 . . . covering wall
35 . . . auxiliary spring piece
36 . . . protection wall
36A . . . tip part
36B . . . base end part
37 . . . chamfered portion
37A . . . first tapered surface
37B . . . second tapered surface
38 . . . excessive deflection preventing portion
50 . . . collective rubber plug
51 . . . hole
52 . . . inner wall
S . . . slit

The invention claimed is:

1. A terminal fitting to be inserted into a hole of a rubber plug, comprising:

a main body in the form of a rectangular tube;

a main spring piece provided in the main body and configured to resiliently come into contact with a mating terminal; and an auxiliary spring piece provided in the main body and capable of contacting the main spring piece from a side opposite to the mating terminal, wherein:

the main body includes a bottom wall, a pair of side walls extending from opposite side edges of the bottom wall while facing each other and a ceiling wall arranged to face the bottom wall; and the auxiliary spring piece is cantilevered from the bottom wall, protection walls for laterally covering the auxiliary spring piece are formed on end parts of the side walls on the side of the bottom wall and corner parts of the side walls and the bottom wall, chamfered portions are formed on surfaces of the protection walls capable of contacting an inner wall of the hole of the rubber plug, and outer surfaces of the chamfered portions are located more inwardly of the main body than those of the corner parts of the side walls and the bottom wall.

2. The terminal fitting of claim 1, wherein the chamfered portion includes a first tapered surface formed by striking a corner part of a tip part of the protection wall.

3. The terminal fitting of claim 1, wherein the chamfered portion includes a second tapered surface formed continuously with the first tapered surface by bending a base end part of the protection wall.

4. The terminal fitting of claim 3, wherein slits are formed from the tip part to the base end part of the protection wall both before and after the protection wall.

5. The terminal fitting of claim 1, wherein the main spring piece includes a turned portion extending forward from a front edge of the bottom wall along a substantially arcuate path and a tongue piece extending back from an extending end of the turned portion and having a contact portion to be held in contact with the mating terminal, covering walls for laterally covering the turned portion are formed on end parts of front end sides of the side walls on the side of the bottom wall, and the covering walls are shaped to be aligned with the protection walls in a front-back direction.

* * * * *